United States Patent [19]

Hirokawa et al.

[11] 4,435,210

[45] Mar. 6, 1984

[54] REFINING AGENT OF MOLTEN METAL AND METHODS FOR PRODUCING THE SAME

[75] Inventors: Norio Hirokawa; Tsuneo Kawachi, both of Chichibu; Hiroshi Saito, Abiko; Ryoichi Yoshimura, Koganei, all of Japan

[73] Assignee: Showa Denko Kabushiki Kaisha, Tokyo, Japan

[21] Appl. No.: 466,188

[22] Filed: Feb. 14, 1983

[30] Foreign Application Priority Data

Feb. 12, 1982 [JP] Japan ..... 57-19696
Feb. 12, 1982 [JP] Japan ..... 57-19697
May 14, 1982 [JP] Japan ..... 57-80089

[51] Int. Cl.[3] ..... C21C 7/02

[52] U.S. Cl. ..... 75/53; 75/52; 75/58

[58] Field of Search ..... 75/53, 58, 52

[56] References Cited

U.S. PATENT DOCUMENTS 3,575,695 4/1971 Miyashita ..... 75/58
3,992,195 11/1976 Klapdar ..... 75/58

*Primary Examiner*—Peter D. Rosenberg
*Attorney, Agent, or Firm*—Sughrue, Mion, Zinn, Macpeak & Seas

[57] ABSTRACT

The present invention relates to a refining agent used for deoxidation, desulfurization, and dephosphorization of molten steel by a ladle refining, as well as methods for producing such a refining agent. The general practice in ladle refining is to use for the refining agent both so-called flux, which is mainly composed of CaO, and a Ca-based metallic additive.

In conventional practice, the flux and the Ca-based metallic additive are added to the molten steel separately.

It is an object of the present invention to provide a refining agent, wherein the flux and metallic CaO component act highly effectively on the molten metal.

A refining agent for metal according to the present invention essentially consists of: a Ca alloy, which essentially consists of Ca and at least one element selected from the group consisting of Al and Si, and a flux mainly composed of CaO and $Al_2O_3$, the Ca-alloy phases and the flux phases being integrally bonded to one another.

According to the method of present invention, the reduction of CaO by the metallic reducing agent allows the Ca alloy phase and flux phase to be very uniformly mixed with one another, with the result that the vaporization loss of metallic Ca can be suppressed to a high extent.

22 Claims, 1 Drawing Figure

( X 375 )

REFINING AGENT OF MOLTEN METAL AND METHODS FOR PRODUCING THE SAME

BACKGROUND OF THE INVENTION

1. Field of the Invention

The present invention relates to a refining agent used for deoxidation, desulfurization, and dephosphorization of molten metal, especially molten steel, as well as methods for producing such a refining agent.

2. Description of the Prior Art

Recently, the so-called high purity-steels, which offer high reliability under very severe environmental conditions, have usually been produced by subjecting molten pig iron to desulfurization, dephosphorization, and other preliminary refining and then subsequently carrying out ladle refining of the molten steel or refining of the molten steel outside the steelmaking furnace. The ladle refining, etc. is meant to attain drastic desulfurization, removal of the $Al_2O_3$ non-metallic inclusions, and modification of the non-metallic inclusions. The ladle refining, etc. is occasionally additionally meant to attain dephosphorization.

The refining agents differ according to the desired effect, but the general practice in ladle refining is to use both so-called flux, which is mainly composed of CaO, and a Ca-based metallic additive. The use of a Ca-based metallic additive using metallic Ca or a CaSi alloy is said to be indispensable for the modification of non-metallic inclusions.

The Ca-based metallic additives used are generally metallic Ca, a Ca—Si alloy, or a clad wire in which metallic Ca or both metallic Ca and Al are clad with an iron or aluminum sheath.

Metallic Ca and Ca—Si alloy are relatively inexpensive but are disadvantageous in that the metallic Ca or Ca—Si alloy exhibits a low reaction efficiency. The Ca—Si alloy can only be used for steels containing Si but cannot be used for Si-less Al-killed steels. In addition, fumes are generated due to addition of the Ca—Si alloy to the molten steel, which results in a poor working environment. On the other hand, while clad wire exhibits a high reaction efficiency, it is very expensive. Clade wire can therefore only be practically employed for refining certain kinds of steels.

The flux used is usually composed mainly of CaO and an additional one or more of $Al_2O_3$ and $CaF_2$. Use of flux together with the Ca-based metallic additive enables greater effectiveness in purification of the molten steel.

In conventional practice, the flux and the Ca-based metallic additive are added to the molten steel separately, e.g., the flux is added to melt first and then the Ca-based metallic additive is added. If the flux and Ca-based metallic additive are mixed with one another and simultaneously added to the molten steel, the metal phase and the flux phase substantially separate from one another in the molten steel, with the result that not only cannot the vaporization loss of the metallic Ca, which has a high vapor pressure at the temperature of molten steel, be suppressed, but also the non-metallic inclusions cannot be satisfactorily captured by the CaO. In conventional practice, however, since the flux and Ca-based metallic additive are added to the molten steel at a different time, a simultaneous and instantaneous reaction between the metallic Ca component and the flux cannot be realized.

Two of the more common Ca-based metallic additives used as refining agents comprise a Ca—Al alloy or a Ca—Si alloy. Several methods for producing a Ca—Al alloy have been previously proposed. In one method, CaO and $Al_2O_3$ are reduced in an electric furnace by means of carbon. This method is difficult to carry out effectively on an industrial scale. In another method, briquettes are made of CaO and Al and are heated to a temperature of from 1500° C. to 1600° C. to cause a reaction between the CaO and Al and liquefaction of the Ca—Al alloy and slag. This method is, however, also difficult to carry out on an industrial scale because the reaction carried out at a high temperature in ambient air results in loss of Al and Ca due to vaporization, oxidation, and nitridation.

In addition, several methods for producing a Ca—Si alloy have been previously propsed. They include, for example, a method of reducing CaO by means of metallic Si, a method of reducing quartzite and quick lime by means of a carbonaceous reducing agent, and a method of reducing quartzite by means of calcium carbide ($CaC_2$) and a carbonaceous reducing agent. In these methods, there is serious loss of the metallic Ca due to vaporization, and the Ca content of the resultant Ca—Si alloy is approximately 38% at the highest. Use of the products obtained by these methods as refining agents of metal would result in not only considerable consumption of the refining agent for treating the molten metal, but also the unavoidable formation of a $SiO_2$ component in these products, which component would deleteriously combine with the CaO and thus impede desulfurization and dephosphorization. In order to remove the $SiO_2$ component from the products and to eliminate the disadvantages, the slag must be necessarily separated from the alloy obtained by these methods.

SUMMARY OF THE INVENTION

It is an object of the present invention to provide a refining agent for metal which comprises flux and a metallic CaO component, wherein the flux and metallic Ca component act highly effectively on the molten metal and the deoxidation, desulfurization, dephosphorization, and modification of non-metallic inclusions are improved.

It is especially an object of the present invention to provide a refining agent for metal which substantially suppresses the vaporization loss of metallic Ca in the molten steel and thus enhances the reaction efficiency of metallic Ca, while improving the non-metallic inclusion capturing ability of the flux.

It is another object of the present invention to provide methods for producing the refining agent for metal mentioned above.

In accordance with the objects of the present invention, there is provided a refining agent for metal, essentially consisting of: a Ca alloy, which essentially consists of Ca and at least one element selected from the group consisting of Al and Si, and a flux mainly composed of CaO and $Al_2O_3$, the Ca-alloy phases and the flux phases being integrally bonded to one another. According to one aspect of the present invention, the Ca-alloy phases and the flux phases are integrally bonded to one another in such a manner that the flux substantially suppresses the local vaporization of the reducing metal occurring in the molten metal when the refining agent is brought into contact with the molten metal. According to another aspect of the present invention, the Ca-alloy phases and the flux phases are integrally bonded to one another in such a manner that the Ca-alloy phases and flux phases are homogeneously distributed in the molten steel when added to the molten steel.

It is preferable that the refining agent of the present invention contain the main components, i.e., the Ca alloy and the flux, in an amount of at least 70% by weight (all percentage hereinafter also based on weight). Other components may be, typically, $CaF_2$, which is effective for promoting the slagging of the flux when the refining agent is added to the molten steel. The amount of $CaF_2$ is preferably 30% or less. $CaF_2$ forms phases which are separated from the flux phases. It is preferable that the amount of $CaF_2$ be increased with the increase in the $CaO/Al_2O_3$ ratio. However, the maximum amount of $CaF_2$, i.e., 30%, should be maintained, because amounts of $CaF_2$ exceeding 30% are no more effective in promoting slagging of flux than 30% amounts.

One method for producing the refining agent according to the present invention comprises the steps of mixing oxides mainly composed of CaO with a metallic reducing agent mainly composed of Al so as to form briquettes and baking the briquettes in an inert gas atmosphere so as to obtain a product essentially consisting of Ca-Al alloy, CaO, and $Al_2O_3$. The baking temperature is preferably from 850° C. to 1350° C., more preferably than 1000° C. to 1200° C.

For example, a refining agent comprising Ca alloy phases, flux phases, and a primary binder can be produced by means of mixing a Ca alloy, flux powders, and an organic binder, and then shaping the mixture in briquettes using briquetting machines or, for a small-sized refining agent, using a granulation method, that is, covering the alloy particles with flux powders around the surface thereof. In this method, the CaO is partly reduced to metallic Ca and the resultant metallic Ca is alloyed with metallic Al, with the result that the resultant product is mainly composed of the Ca alloy, CaO, and $Al_2O_3$. This product is then crushed, particulated or shaped into a lump form so as to obtain a desired grain-sized or dimension adaptable for use as the refining agent for metal.

The reduction of CaO by the metallic reducing agent allows the Ca alloy phase and flux phase to be very uniformly mixed with one another, with the result that the vaporization loss of metallic Ca can be suppressed to a high extent. The more uniformly of the Ca alloy phases and flux phases are mixed, the more the vaporization loss of the metallic Ca can be suppressed.

Contrary to the conventional methods, in the method according to the present invention, in which Al reduces CaO and is captured by the resultant metallic Ca it is not necessary to deliberately separate the Ca alloy from the slag or flux; the reducing reaction of CaO can proceeds at a relatively low temperature; and it is possible to obtain in one stroke the Ca alloy and flux composed of the mixture of CaO, effective for desulfurization and dephosphorization, as well as $12CaO.7Al_2O_3$, highly effective for capturing $Al_2O_3$ included in molten steel.

Another method for producing the refining agent according to the present invention comprises the steps of mixing oxides mainly composed of CaO with metallic Si and a metallic reducing agent mainly composed of Al so as to form briquettes and baking the briquettes in an inert gas atmosphere so as to obtain a product essentially consisting of Ca—Si alloy or Ca—Si—Al alloy, CaO, and $Al_2O_3$. The baking temperature is also preferably from 850° C. to 1350° C., more preferably from 1000° C. to 1200° C.

When the refining agent according to the present invention contains silicon, the reducing reaction efficiency of CaO is enhanced and the resultant metallic Ca can be so reliably captured by the metallic Si that a Ca alloy with a high Ca content can be obtained. In addition, the metallic Si of the Ca alloy phases integrally combined with the flux phases suppresses the vaporization loss of the metallic Ca very low during refining of the molten steel. Thus, a refining agent which contains metallic Si is very advantageous for deoxidation, desulfurization, and dephosphorization.

According to this method, CaO is partly reduced by the metallic reducing agent, which essentially consists of metallic Al, and the resultant metallic Ca is incorporated into the metal phases, which essentially consist of Si or both Si and Al. The Ca-alloy phases have a high Ca content due to Si as described hereinabove. In this method a slag is formed during the reducing reaction. In the slag $Al_2O_3$ combines with an excess CaO to form a compound essentially consisting of $12CaO.7Al_2O_3$. When flux phases comprise $12CaO.7Al_2O_3$, the non-metallic inclusions, mainly $Al_2O_3$, included in molten steel are very effectively captured by the flux phases. According to this method, the metallic reducing agent and the metal phases which essentially consist of Si permeate into minute pores of CaO particles, partly reduce CaO, and simultaneously capture the resultant metallic Ca, with the result that a refining agent, in which the Ca-alloy and flux phases which are integrally, homogeneously and densely bonded with each other can be obtained in one stroke.

BRIEF DESCRIPTION OF THE DRAWING

The present invention will now be described in more detail in reference to preferred embodiments and a drawing, FIG. 1 showing the integral, homogeneous, and dense bonding between the Ca alloy phases and the flux phases.

DESCRIPTION OF THE PREFERRED EMBODIMENTS

Figure 1:
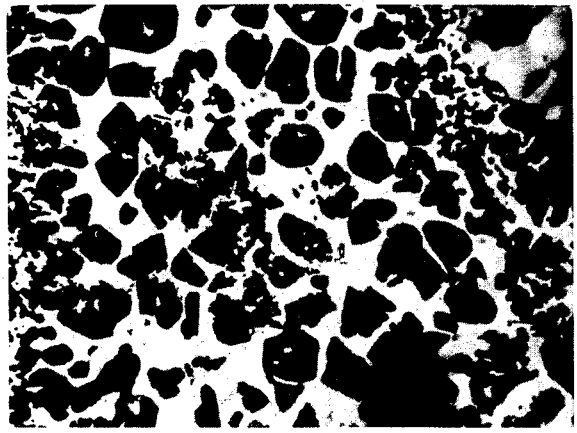

The composition of the refining agent according to the present invention is first explained with regard to preferred embodiments.

According to one embodiment of the present invention, the refining agent is a pulverized, granular, or agglomerate body in which Ca alloy phases consisting of Ca—Al alloy are integrally bonded with flux phases mainly composed of CaO and $Al_2O_3$. The refining agent preferably contains from 20% to 50% Ca—Al alloy, from 50% to 80% $CaO+Al_2O_3$, and from 0% to 30% $CaF_2$. An amount of Ca—Al alloy less than 20% results in ineffective refining by this alloy and a correspondingly greater amount of refining agent necessary to treat the molten metal. On the other hand, an amount of Ca—Al alloy more than 50% results in a decreased amount of flux relative to the Ca alloy and ineffective suppression of the vaporization loss of the metallic Ca.

The Ca content of the Ca—Al alloy is preferably from 20% to 50%. A Ca content less than 20% means too high an Al content in the Ca-alloy and results in increased residual Al in the steel and decreased refining efficiency. On the other hand, a Ca content more than 50% not only makes production of the refining agent difficult, but also increases the vaporization loss of the metallic Ca.

The $CaO/Al_2O_3$ ratio of flux is preferably from 0.9 to 5.0. A $CaO/Al_2O_3$ ratio less than 0.9 means only a small amount of CaO effective for desulfurization and thus a lowered desulfurization degree. On the other hand, a $CaO/Al_2O_3$ ratio more than 5.0 means an increased melting point of flux and a resultant impeded slagging of the flux. A composition of CaO and $Al_2O_3$ of approximately $12CaO.7Al_2O_3$ is desirable in terms of the ability to capture non-metallic inclusions.

The refining agent according to the present invention in which the Ca alloy is a Ca—Al alloy and in which $CaF_2$ may be contained may further contain, in order to lower the melting point of the slag and improve the flowability of the slag, a minor amount of $CaCl_2$, $Na_2O$, Si, Mg, Ba, Ni, a rare-earth, or other elements, or an oxide of such elements, such as $SiO_2$, MgO, BaO, and NiO. The total amount of $CaCl_2$, $Na_2O$, and the like should not exceed 10%. The $CaF_2$, $CaCl_2$, $Na_2O$ and the like can be added to the raw materials for producing the refining agent to obtain a refining agent containing $CaF_2$, $CaCl_2$, $Na_2O$, and the like.

$SiO_2$ may be contained in the refining agent as an impurity. Since $SiO_2$ is liable to combine with CaO in the flux phases and thus reduceds the effectiveness of CaO, amount of $SiO_2$ should not exceed 5% to attain a satisfactory refining effect.

According to another embodiment of the present invention, the refining agent is a pulverized, granular, or agglomerate body in which Ca alloy phases consisting of Ca—Si alloy or Ca—Si—Al alloy are integrally bonded with flux phases mainly composed of CaO and $Al_2O_3$. The refining agent preferably contains from 30% to 65% of a Ca-Si alloy or Ca—Si—Al alloy, from 35% to 70% of $CaO+Al_2O_3$, desirably with a $CaO/Al_2O_3$ ratio from 0.9 to 3.0, and from 0% to 30% of $CaF_2$. An amount of Ca—Si alloy or Ca—Si—Al alloy less than 30% results in ineffective refining by this alloy and a correspondingly greater amount of refining agent necessary to treat the molten metal. On the other hand, an amount of Ca—Si alloy or Ca—Si—Al alloy more than 65% results in a decreased amount of flux relative to the alloy and ineffective suppression of the vaporization loss of the metallic Ca.

The Ca content of the Ca—Si alloy or Ca—Si—Al alloy is preferably from 30% to 60%. A Ca content less than 30% means too high an Si or Si and Al content in the Ca—Si alloy or Ca—Si—Al alloy and results in increased residual Si and Al in the steel, thus damaged quality of the steel, and reduced effectiveness of the metallic Ca for refining. On the other hand, a Ca content more than 50% not only makes production of the refining agent difficult, but also increases the vaporization loss of the metallic Ca during treatment of the molten steel to an economically unacceptable level.

The content of metallic Si in the Ca—Si alloy or Ca—Si—Al alloy is preferably at least 10%. A content of Si less than 10% results in an unsatisfactorily high reducing-reaction efficiency of CaO by using Al during the production of the refining agent and inability of the Ca-alloy phases and flux phases to be integrally combined with one another in such a manner that the vaporization loss of the metallic Ca is effectively suppressed within the molten steel. With the Ca—Si—Al alloy, the silicon pick-up of molten steel can be suppressed to a very low value while a refining effect equivalent to that attained by the Ca—Si alloy.

The $CaO/Al_2O_3$ ratio of flux is preferably from 0.9 to 3.0. A $CaO/Al_2O_3$ ratio less than 0.9 means only a small amount of CaO effective for desulfurization and thus a lessened desulfurization degree. On the other hand, a $CaO/Al_2O_3$ ratio more than 3.0, means an increased melting point of flux and a resultant impeded slagging of the flux. A composition of CaO and $Al_2O_3$ of approximately $12CaO.7Al_2O_3$ is desirable in terms of the ability to capture non-metallic inclusions.

The content of Ca in the Ca—Si alloy or the Ca—Si—Al alloy can be enhanced in accordance with an increase in amount of Al mixed in the raw materials, because Al reduces CaO. Either the Ca—Si alloy or Ca—Si—Al alloy can be selected in accordance with the kind of steel to which the refining agent is to be applied.

The important role of the flux phases according to the present invention is to enable the Ca alloy phases to adequately dissolve into the molten steel, as described more specifically hereinafter. When the refining agent is added to the molten steel, if the reaction between the Ca alloy phases and molten steel proceeds instantaneously, the metallic Ca is liable to abruptly vaporize. The flux phases prevent an instantaneous reaction and enable the Ca alloy to gradually dissolve in the molten steel. Thus, a satisfactorily efficient reaction can be attained between the metallic Ca and the molten steel. In addition, the flux phases effectively capture and then remove the desulfurization and deoxidization products, such as CaS and $mCaO.nAl_2O_3$, included in the molten steel.

To prevent instantaneous reaction of the Ca alloy phases and the molten steel and thus enable the Ca alloy phases to dissolve gradually upon addition of the refining agent to the molten steel, the individual particles, agglomerates, or other constituents of the refining agent should be composed so that the surface or the periphery of the Ca alloy phases is covered with the flux phases. Therefore, the integral bonding between the Ca-alloy phases and the flux phases of the refining agent according to the present invention must be maintained at least until directly after the refining agent is added to the molten steel. "Integral bonding" herein means both that the individual particles, agglomerates, or other constituents of the refining agent include integrally bonded Ca alloy and flux phases and that the particles, agglomerates, etc. consisting of the Ca alloy phases and flux phases are themselves mutually bonded together by means of a primary binder. Desirably, the integral bonding is such that the Ca alloy phases and flux phases are mixed and then bonded by means of sintering, diffusion, forming solid-solution, and the like. More desirably, either of the Ca alloy and flux phases or both together should form a matrix phase and be complicately and coherently interwound, as can be attained by sintering. Further desirably, the alloy phases should be melted to permeate into the minute pores of the CaO particles, reduces CaO, then solidify in the pores so that the Ca-alloy phases and flux phases form a matrix phase with each other in a coherent manner. This can be attained by the methods of present invention and is very advantageous because the bonding is not only integral, but also homogeneous and dense.

FIG. 1 shows integral, homogeneous, and dense bonding between the Ca alloy phases and the flux phases. The Ca alloy phases and flux phases, seen as white and black, respectively, are finely interwound and strongly and uniformly bonded with each other. When the bonding is integral, homogeneous, and dense as shown in FIG. 1, the bonding between the Ca alloy and flux phases is integral no matter what the physical form the refining agent takes, i.e., whether the refining agent is formed as briquettes or relatively large size particles or as a fine powder. In an actual test, a refining agent having a size exceeding 1 mm was crushed. Investigations showed that more than 70% of the 0.5 to 1.0 mm granulates had integrally bonded Ca alloy phases and flux phases. When above mentioned percentage is high, integral bonding is uniformly achieved in the refining agent. This is important for refining agents, such as briquettes, having a relatively large grain size and can be investigated by crushing the refining agent. The uniform dispersion of integral bonding is now very significant for the refining agent having a relatively small grain-size, for example smaller than 1 mm.

The refining agent according to the present invention can be formed in various sizes, from 1 mm or less particles or powders, usually used for the injection metallurgy method, to briquettes or agglomerates. The size of the particles or powders is not specifically limited and is optionally selected in accordance with the applications, etc., e.g., the argon-stirring method, the RH process, and other ladle refining processeses as well as Ca treatment in continuous casting. The size of the briquettes or aggregates is not specifically limited and is optionally selected in terms of ease of handling. The refining agent according to the present invention can be used not only for refining steels but also for treatment of molten metal us hot pig iron and Al alloys.

A preferred method for producing the refining agent according to the present invention, in which the obtained Ca alloy is a Ca—Al alloy, will now be described in detail.

The raw materials used are basically oxides mainly composed of CaO and a metallic reducing agent mainly composed of Al. The oxide may be CaO alone or CaO mixed with other oxides (described later), chlorides, or fluorides. The metallic reducing agent may be Al alone, Al mixed with Si or Mg, or an Al-alloy containing Si or Mg. Minor amount of Si, for example less than 10% of Si, retains in the Ca—Al alloy, when the metallic reducing agent contains Si, for example Silunin does.

The raw materials are crushed and then briquetted to promote a reaction therebetween. During the reaction, the Al melts and permeates into the oxide or CaO particles. The grain size of the raw materials, such as CaO and Al, is therefore not very significant, though it is preferably approximately 1 mm or less. The briquettes may be compression formed by means of a briquetting machine or the like or may be formed by granulating the mixture of raw materials with starch, carboxymethyl cellulose (CMC), or another primary binder. The briquettes can be a granular, aggregate, or any other shape. The size of the briquettes is not specifically limited, but is preferably from 5 to 50 mm.

The amounts of CaO and metallic reducing agent are determined in accordance with the composition of the refining agent to be produced and the following reducing reaction formula:

$$3CaO+2Al\ 3Ca+Al_2O_3 \quad (1).$$

Since the reducing reaction does not proceed completely, the resultant Ca is alloyed with the Al raw materials. The resultant $Al_2O_3$ combines with an excess CaO to constitute the flux. The vaporization loss of metallic Ca is suppressed due to the flux and due to alloying of Ca with Al.

To obtain the preferred composition of the refining agent, i.e. from 20% to 50% of Ca—Al alloy, containing from 20% to 50% of Al, and from 50% to 80% of $CaO+Al_2O_3$ with a $CaO/Al_2O_3$ ratio of from 0.9 to 5.0, the weight ratio of CaO/Al in the raw materials is adjusted taking into consideration the vaporization loss of Ca during the reducing reaction, to the range of from 0.5 to 4.0. To obtain a refining agent which contains one or more of $CaF_2$, $CaCl_2$, $Na_2O$, $SiO_2$, Mg, Ba, Ni, rare earths, oxides of Mg, Ba, Ni, and rare earths, and other compounds and elements, the desired compounds or elements may be incorporated in the raw materials. When the raw materials contain oxides, such as of Mg, Ba, Ni, and rare earths, the oxides may be partly reduced by the Al or Ca. The refining agent may contain metal, such as Mg, Ba, Ni, or a rare earth, formed by such partial reduction if such metal is not detrimental to the molten metal to be treated by the refining agent. The metal formed by such a partial reduction forms the Ca alloy phases along with the Ca—Al alloy, although a minor part of such metal may be present as an impurity in the flux phases which contain compounds such as $CaCl_2$.

A reducing reaction is initiated in the briquettes by baking at a temperature of from 850° C. to 1350° C., preferably at a temperature of from 1000° C. to 1200° C., in an inert atmosphere, such as an argon atmosphere. Baking in ambient air or a nitrifying atmosphere is not impossible but is not preferable because the reducing reaction would then be suppressed due to, for example, formation of AlN (aluminum nitride) and the like. A temperature less than 850° C. is too low for the reducing reaction to take place. On the other hand, a high temperature more than 1350° C. is not only not meritorious at all for the reducing reaction, but also results in a great vaporization loss of the metallic Ca.

The pressure of reaction atmosphere may be somewhat less than atmospheric pressure, which seems to be advantageous for promoting the reducing reaction according to the above formula (1). Alternatively, the pressure of the reaction atmosphere may be slightly higher than atmospheric pressure in order to suppress the vaporization of the metallic Ca.

The furnace used for the baking need not be of any specific type so long as the reaction atmosphere within the furnace can be controlled to be substantially inert. For example, a horizontal car-bottom type furnace, a vertical shaft furnace, or a retort furnace may be used. A furnace in which the raw materials are transferred by means of furnace rotation can be used to realize continuous baking or to promote the reducing reaction.

The baked briquettes can be directly used as the refining agent or can be crushed into granules or further pulverized into particles or powder to obtain a finely divided refining agent. It is to be noted that in each particle or any other constituent of the refining agent the Ca alloy phases and flux phases are integrally bonded with each other. Observation of the particles or the like by means of an optical microscope or an X-ray micro-analyzer reveals the very fine Ca—Al alloy phases, such as phases of $CaAl_2$ or $CaAl_4$, and the flux phases, such as phases of CaO and $12CaO.7Al_2O_3$, to be complicatedly interwined with each other.

A preferred method for producing the refining agent according to the present invention, in which the obtained Ca alloy contains Si, will now be described in detail.

The raw materials used are basically oxides mainly composed of CaO, advisably quick lime, a metallic reducing agent mainly composed of Al, e.g., pure Al or an Al-alloy, and metals mainly composed of Si, e.g., metallic Si, ferrosilicon, or Al—Si alloy. For the metals, ferrosilicon, which has a high silicon content, is desirable. Ferrosilicon-aluminum, which has almost equal contents of Al and Si, may be used if the amount of Al from the metallic reducing agent is not sufficient and must be compensated for.

The raw materials are crushed and then briquetted to promote a reaction therebetween. During the reaction between the raw materials, the metal, i.e., Al or both Al and Si, melts and permeates into the pores of the oxide or CaO particles. Such permeation is promoted due to the presence of metallic Si as compared with the case of the previous described method according to the present invention, in which only the metallic reducing agent, i.e., Al, is mixed with the oxides. Thus, the metallic Si enables improved reducing-reaction efficiency of the CaO. Like the previously described method, the grain size of the raw materials is, not very significant but is preferably approximately 1 mm or less. The briquettes may also be compression-formed by means of a briquetting machine or the like or may be formed by granulating the mixture of raw materials with starch, CMC, or another primary binder. The briquettes can also be a granular, aggregate, or any other shape, and the size of the briquettes is also not specifically limited but is preferably from 5 to 50 mm.

The amounts of oxides and metallic reducing agent are determined in accordance with the composition of the refining agent to be produced and reducing-reaction formula (1). The resultant metallic Ca is captured by the Si, which coexists with it in the raw materials, and either Ca—Si alloy or Ca—Si—Al alloy is formed. In the latter case, the Ca—Si—Al alloy is formed when excess Al is incorporated into the Ca alloy. The resultant $Al_2O_3$ combines with an excess CaO to form $mCaO.nAl_2O_3$.

It is to be noted that the reducing reaction of CaO is attained only by the Al. Such reducing can be promoted in accordance with an increase in the Si/Al ratio in the raw materials to such a degree that the content of Ca in the resultant Ca alloy amounts to 60%. However, a very high Si/Al ratio in the raw materials results in Si participating in the reducing reaction and the disadvantageous formation of a ternary flux phases comprising $CaO—Al_2O_3—SiO_2$. When CaO is reduced only by Si, the Ca—Si alloy and slag mainly comprising $2CaO.SiO_2$ are disadvantageously formed. Slag having a high $SiO_2$ content is not very effective for refining molten steel and is thus disadvantageous. To keep the $SiO_2$ content of the refining agent to a value of 5% or less, the raw materials should have a CaO/(Al+Si) ratio of 2.5 or less and a Si/Al ratio of approximately 4 or less. The type and atmosphere of the furnace, the form of raw materials, etc. are the same as those of the method in which the Ca-alloy is the Ca—Al alloy. It is to be noted that in each particle or any other constituent of the refining agent, the Ca alloy phases, essentially consisting of Ca—Al alloy or Ca—Si—Al alloy, and the flux phases, essentially consisting of CaO and $Al_2O_3$, are integrally, homogeneously, and densely bonded with one another. Observation of the particles or the like by means of an optical microscope or an X-ray micro-analyzer verifies the very fine Ca alloy phases are mixed in the flux phases which essentially consists of CaO and $12CaO.7Al_2O_3$.

The present invention will now be explained by way of examples.

EXAMPLE 1

Quick lime containing 97.5% of CaO was crushed into particles having a size of 1 mm or less. A total of 670 parts by weight of the quick lime particles and 330 parts by weight of Al alloy shavings containing 90% of Al were mixed well and then shaped into almond-form briquettes. The briquettes were loaded into a closable horizontal car-bottom type furnace with an internal heating system. The air in this furnace was replaced with Ar having the pressure of 1 atm. The temperature in the furnace was then elevated up to 1100° C., and was held there for 3 hours. The furnace was then cooled. The briquettes were withdrawn from the furnace and chemically analyzed to quantitatively determine the briquette components. It was revealed that the briquettes consisted of 16.7% Ca, 22.5% Al, 37.0% CaO, and 21.5% $Al_2O_3$. The briquettes were also subjected to X-ray diffraction which indicated clear peaks of $CaAl_2$, CaO, and $12CaO.7Al_2O_3$. The Ca content of the Ca alloy phase was approximately 40%.

The briquettes were then finely divided as if for injection metallurgy, that is, until all of them passed through a 60 mesh. Thereafter, individual particles of the obtained powder were observed using an optical microscope and an X-ray micro-analyzer. This revealed that all particles had an integrally bonded structure of the Ca alloy phases and flux phases.

The finely divided particles mentioned above were used for refining molten steel, as described below. In a high-frequency induction furnace with an electrofused magnesia lining, 30 kg of Al—Si-killed steel was melted. The above-mentioned finely divided particles were added in an amount of 0.8% based on the weight of the molten steel when the molten steel was under an argon atmosphere. After 15 minutes, the molten steel was cast into a metal mold.

For the purpose of comparison, Ca alloy particles having the same Al and Ca contents as those of the Ca alloy phases of the present invention and flux particles having the same CaO and $Al_2O_3$ contents as those of the flux phases of the present invention were merely mixed with each other. The mixture was added to the molten steel under the same conditions as described above.

Samples were obtained from the cast ingots, and the sulfur content and morphology of non-metallic inclusions were investigated. The results are shown in Table 1.

TABLE 1

| Refining agent | Sulfur content (%) Before refining | Sulfur content (%) After refining | Controlling-ability of morphology by type of non-metallic inclusions: $mCaO.nAl_2O_3$ | Controlling-ability of morphology by type of non-metallic inclusions: Ca—Al—O—S |
|---|---|---|---|---|
| Invention | 0.021 | 0.003 | o | o |
| Comparison | 0.022 | 0.010 | x | x |

The symbol o in Table 1 indicates that fine calcium-aluminate non-metallic inclusions and fine globular $CaO—Al_2O_3—CaS$ non-metallic inclusions were detected in the refined steel. The symbol x indicates that these non-metallic inclusions were not detected, but that $Al_2O_3$ clusters and MnS were formed in the refined steel.

No abrupt generation of fumes was observed after addition to the molten steel of the finely divided particles according to the present invention. Therefore, it was confirmed that sudden vaporization of Ca was suppressed according to the present invention.

EXAMPLE 2

Quick lime containing 97.5% of CaO was crushed into particles having a size of 1 mm or less. A total of 540 parts by weight of the quick lime particles, 110 parts by weight of Al alloy shavings containing 90% of Al, and 350 parts by weight of metallic Si with purity of 98% were mixed well and then shaped into almond-form briquettes. The briquettes were loaded into a closable horizontal car-bottom type furnace with an internal heating system. The air in this furnace was replaced with Ar having the pressure of 1 atm. The temperature in the furnace was then elevated up to 1100° C., and was held there for 3 hours. The furnace was then cooled. The briquettes were withdrawn from the furnace and chemically analyzed to quantitatively determine the briquette components. It was revealed that the briquettes consisted of 23.6% Ca, 33.0% Si, 19.1% CaO, and 20.3% $Al_2O_3$. The briquettes were also subjected to X-ray diffraction which indicated clear peaks of $CaSi_2$, and $12CaO.7Al_2O_3$. The Ca content of the Ca alloy phase was approximately 42%.

The briquettes were than finely divided until all of them passed through a 60 mesh. Thereafter, individual particles of the obtained powder were observed using an optical microscope and an X-ray micro-analyzer. This revealed that almost all particles had a bonded structure of the Ca alloy phases and flux phases.

The finely divided particles mentioned above were used for refining molten steel, as described below. In a high-frequency induction furnace with an electrofused magnesia lining, 30 kg of Al—Si-killed steel was melted. The above-mentioned finely divided particles were added in an amount of 0.8% based on the weight of the molten steel when the molten steel was under an argon atmosphere. After 15 minutes, the molten steel was cast into a metal mold.

For the purpose of comparison, mentioned Ca alloy particles having the same Si and Ca contents as those of the Ca alloy phases of the present invention and flux particles having the same CaO and $Al_2O_3$ contents as those of the flux phases of the present invention were merely mixed with each other. The mixture was added to the molten steel under the same conditions as described above.

Samples were obtained from the cast ingots and the sulfur content and morphology of non-metallic inclusions were investigated. The results are shown in Table 2.

TABLE 2

| Refining agent | Sulfur content (%) Before refining | Sulfur content (%) After refining | Controlling-ability of morphology by type of non-metallic inclusions: $mCaO.nAl_2O_3$ | Controlling-ability of morphology by type of non-metallic inclusions: Ca—Al—O—S |
|---|---|---|---|---|
| Invention | 0.024 | 0.003 | o | o |
| Comparison | 0.023 | 0.012 | x | x |

The symbol o in Table 2 indicates that fine calcium-aluminate non-metallic inclusions and fine globular $CaO—Al_2O_3—CaS$ non-metallic inclusions were detected in the refined steel. The symbol x indicates that these non-metallic inclusions were not detected, but that $Al_2O_3$ clusters and MnS were formed in the refined steel.

No abrupt generation of fumes was observed after addition to the molten steel of the finely divided particles according to the present invention. Therefore, it was confirmed that sudden vaporization of Ca was suppressed according to the present invention.

EXAMPLE 3

Quick lime containing 97.5% of a CaO was crushed into particles having size of 1 mm or less. A total of 550 parts by weight of the quick lime particles, 280 parts by weight of Al alloy shavings containing 90% of Al, and 170 parts by weight of metallic Si with purity of 98% were mixed well and then shaped into almond-form briquettes. The briquettes were loaded into a closable horizontal car-bottom type furnace with an internal heating system. The air in this furnace was replaced with Ar having the pressure of 1 atm. The temperature in the furnace was then elevated up to 1150° C. and was held there for 3 hours. The furnace was then cooled. The briquettes were withdrawn from the furnace and chemically analyzed to quantitatively determine the briquette components. It was revealed that the briquettes consisted of 23.6% Ca, 15.9% Al, 16.5% of Si, 18.9% CaO, and 20.1% $Al_2O_3$. The briquettes were also subjected to X-ray diffraction which indicated clear peaks of $CaSi_2$, CaO, and $12CaO.7Al_2O_3$. The Ca content of the Ca alloy phase was approximately 42%.

The briquettes were then finely divided until all of them passed through a 60 mesh. Thereafter, individual particles of the obtained powder were observed using an optical microscope and an X-ray micro-analyzer. This revealed that almost all of particles has a bonded structure of the Ca alloy phases and flux phases:

The finely divided particles mentioned above were used for refining molten steel, as described below: In a high-frequency induction furnace with an electrofused magnesia lining, 30 kg of Al—Si-killed steel was melted. The above-mentioned finely divided particles were then added in an amount of 0.8% based on the weight of the molten steel when the molten steel was under an argon atmosphere. After 15 minutes, the molten steel was cast into a metal mold.

For the purpose of comparison, Ca alloy particles having the same Al, Si, and Ca contents as those of the Ca alloy phase of the present invention and flux particles having the same CaO and $Al_2O_3$ contents as those of the flux phases of the present invention were merely mixed with each other. The mixture was added to the molten steel under the same conditions as described above.

Samples were obtained from the cast ingots, and the sulfur content and morphology of non-metallic inclusions were investigated. The results are shown in Table 3.

TABLE 3

| Refining agent | Sulfur content (%) Before refining | Sulfur content (%) After refining | Controlling-ability of morphology by type of non-metallic inclusions: $mCaO.nAl_2O_3$ | Controlling-ability of morphology by type of non-metallic inclusions: Ca—Al—O—S |
|---|---|---|---|---|
| Invention | 0.025 | 0.003 | o | o |

TABLE 3-continued

| Refining agent | Sulfur content (%) Before refining | After refining | Controlling-ability of morphology by type of non-metallic inclusions $mCaO.nAl_2O_3$ | Ca—Al—O—S |
|---|---|---|---|---|
| Comparison | 0.024 | 0.012 | x | x |

The symbol o in Table 3 indicates that fine calcium-aluminate non-metallic inclusions and fine globular $CaO—Al_2O_3—CaS$ non-metallic inclusions were detected in the refined steel. The symbol x indicates that these non-metallic inclusions were not detected, but that $Al_2O_3$ clusters and MnS were formed in the refined steel.

No abrupt generations of fumes was observed after addition to the molten steel of the finely divided particles according to the present invention. Therefore, it was confirmed that sudden vaporization of Ca was suppressed according to the present invention.

We claim:

1. A refining agent for metal, consisting essentially of:
(1) a Ca alloy consisting essentially of Ca and at least one element selected from the group consisting of Al and Si, and
(2) a flux mainly comprising CaO and $Al_2O_3$,
wherein the Ca-alloy and the flux are integrally bonded to one another.

2. A refining agent according to claim 1, containing from 20% to 50% Ca—Al alloy and from 50% to 80% of $CaO+Al_2O_3$.

3. A refining agent according to claim 1, containing from 20% to 50% of a Ca—Al alloy and from 50% to 80% $CaO+Al_2O_3$, wherein the Ca content of said Ca—Al alloy is from 20% to 50% and the $CAO/Al_2O_3$ ratio is from 0.9 to 5.0.

4. A refining agent according to claim 1, containing from 30% to 65% of a Ca—Si alloy and from 35% to 70% $CaO+Al_2O_3$.

5. A refining agent according to claim 1, containing from 30% to 65% of a Ca—Si—Al alloy and from 35% to 70% $CaO+Al_2O_3$.

6. A refining agent according to claim 1, containing from 30% to 65% of a Ca—Si alloy and from 35% to 70% $CaO+Al_2O_3$, wherein the Ca content of said Ca—Si alloy is from 30% to 60% and the $CaO/Al_2O_3$ ratio is from 0.9 to 3.0.

7. A refining agent according to claim 1, containing from 30% to 65% of a Ca—Si—Al alloy and from 35% to 70% $CaO+Al_2O_3$, wherein the Ca content of said Ca—Si—Al alloy is from 30% to 60% and the $CaO/Al_2O_3$ ratio is from 0.9 to 3.0.

8. A refining agent according to claim 1, containing from 30% to 65% of a Ca—Si alloy, and from 35% to 70% $CaO+Al_2O_3$ wherein the Ca content of said Ca—Si alloy is from 30 to 60% and the Si content of said Ca—Si alloy is at least 10%.

9. A refining agent according to claim 1, containing from 30% to 65% of a Ca—Si—Al alloy, and from 35% to 70% $CaO+Al_2O_3$ wherein the Ca content of said Ca—Si—Al alloy is from 30 to 60%, and the Si content of said Ca—Si—Al alloy is at least 10%.

10. A refining agent according to claim 1, wherein said Ca-alloy and is solidified in the minute pores of particles of said CaO.

11. A refining agent according to claim 1, containing from 0% to 30% $CaF_2$.

12. A refining agent according to claim 1, wherein integral bonding is provided by sintering.

13. A refining agent according to claim 1, wherein integral bonding is provided by a binder.

14. A refining agent for metal, consisting essentially of:
(1) a Ca alloy consisting essentially of Ca and at least one element selected from the group consisting of Al and Si, and
(2) a flux mainly comprising CaO and $Al_2O_3$,
wherein the Ca-alloy and the flux are integrally bonded to one another in such a manner that said flux substantially suppresses the local vaporization of the reducing metal occurring in the molten metal when the refining agent is brought into contact with the molten metal.

15. A refining agent for metal, consisting essentially of:
(1) a Ca alloy consisting essentially of Ca and at least one element selected from the group consisting of Al and Si, and
(2) a flux mainly comprising CaO and $Al_2O_3$,
wherein the Ca-alloy and the flux are integrally bonded to one another in such a manner that said Ca alloy and flux are homogeneously distributed in the molten steel when added to the molten steel.

16. A refining agent for metal, consisting essentially of:
(1) a Ca alloy consisting essentially of Ca and at least one element selected from the group consisting of Al and Si, and
(2) a flux comprising CaO and $Al_2O_3$,
wherein the Ca alloy is formed by a partial reduction of said at least one element, and wherein the Ca-alloy and the flux are integrally bonded to one another and the nonoxidized part of said at least one element remains as said Ca-alloy.

17. A method for producing a refining agent comprising the steps of:
(1) mixing (a) oxides mainly comprising CaO with (b) a metallic reducing agent mainly comprising Al, so as to form briquettes, and
(2) backing the briquettes in an inert gas atmosphere so as to obtain a product consisting essentially of Ca—Al alloy, CaO, and $Al_2O_3$.

18. A method according to claim 17, wherein the baking temperature is from 850° C. to 1350° C.

19. A method according to claim 18, wherein the weight ratio of CaO/Al in said briquettes is from 0.5 to 4.0.

20. A method for producing a refining agent comprising the steps of:
(1) mixing (a) oxides mainly comprising CaO with (b) a metallic reducing agent mainly comprising Al and (c) metallic Si, so as to form briquettes, and
(2) baking the briquettes in an inert gas atmosphere so as to obtain a product consisting essentially of Ca—Si alloy or Ca—Si—Al alloy, CaO, and $Al_2O_3$.

21. A method according to claim 20, wherein the baking temperature is from 850° C. 1350° C.

22. A method according to claim 21, wherein the weight ratio of CaO/(Al+Si) is not greater than 2.5 and the weight ratio of Si/Al is not greater than 4 in said briquettes.

* * * * *